United States Patent [19]

Lelental et al.

[11] 4,409,307

[45] Oct. 11, 1983

[54] ELECTRICALLY ACTIVE INORGANIC INTERLAYER FOR ELECTRICALLY ACTIVATABLE RECORDING

[75] Inventors: Mark Lelental, Rochester; Arthur A. Rasch, Webster; David P. Sullivan, Rochester, all of N.Y.

[73] Assignee: Eastman Kodak Company, Rochester, N.Y.

[21] Appl. No.: 411,770

[22] Filed: Aug. 26, 1982

[51] Int. Cl.[3] ..... G03G 13/00; G03G 13/22

[52] U.S. Cl. ..... 430/31; 430/48; 430/52; 430/62; 430/353; 430/477

[58] Field of Search ..... 430/31, 52, 350, 351, 430/477, 353

[56] References Cited

U.S. PATENT DOCUMENTS

| | | | |
|---|---|---|---|
| 3,316,096 | 4/1967 | Rasch et al. | 430/502 |
| 4,234,670 | 11/1980 | Kaukeinen et al. | 430/52 |
| 4,309,497 | 1/1982 | Lelental et al. | 430/48 |
| 4,332,875 | 6/1982 | Lelental et al. | 430/45 |
| 4,343,880 | 8/1982 | Lelental | 430/42 |

FOREIGN PATENT DOCUMENTS 2018453 10/1979 United Kingdom .

OTHER PUBLICATIONS

Research Disclosure, vol. 186, Oct. 1979, 18627.
Research Disclosure, vol. 176, Dec. 1978, 17643.
Research Disclosure, vol. 215, Mar. 1982, 21529.

*Primary Examiner*—John D. Welsh
*Attorney, Agent, or Firm*—Richard E. Knapp

[57] ABSTRACT

In an electrically activatable recording (EAR) element comprising an electrically conductive support bearing (a) a first layer, and, contiguous to the first layer, (b) an electrically activatable recording layer, image formation in the electrically activatable recording layer is aided when the first layer (a) consists essentially of a compound selected from the group consisting of silver chlorides, silver bromides, silver iodides, transition metal bromides, transition metal chlorides, alkali metal chlorides, alkali metal bromides, alkali metal iodides, mixed chlorides, bromides and iodides of such metals and combinations of such compounds. The EAR element is light handleable when free of photosensitive silver halide and provides an image, after electrically activated exposure by dry development processing or by processing in a processing solution or bath.

25 Claims, 5 Drawing Figures

LATENT IMAGE FORMATION

HEAT DEVELOPMENT

LATENT IMAGE FORMATION

ELECTRICALLY ACTIVE INORGANIC INTERLAYER FOR ELECTRICALLY ACTIVATABLE RECORDING

BACKGROUND OF THE INVENTION

1. Field of the Invention

This invention relates to an electrically activatable recording (EAR) element and process in which an inorganic interlayer between an electrically conductive support and an electrically activatable recording layer enhances imaging.

2. Description of the State of the Art

Electrically activatable recording elements and processes are known. They are described in, for example, U.S. Pat. No. 4,234,670. Such EAR elements are useful in forming images by electrically activated recording and dry processing techniques or processing techniques involving processing solutions or baths. Dye forming EAR elements and processes are also known, as described in, for example, *Research Disclosure,* October, 1979, Item No. 18627. It has been desirable to enhance image formation in the electrically activatable recording layer of such elements to enable formation of images having higher maximum densities without increasing the electrical current required for exposure and without adding components to the electrically activatable recording layer.

Certain organic interlayers are useful for aiding imaging in an EAR element, as described in, for example, U.S. Pat. No. 4,309,497. These organic interlayers comprise polymers that generally are expensive to prepare. In our attempt to replace such organic interlayers with less expensive interlayers we found that interlayers comprising many inorganic compounds do not enhance image formation in an EAR element. We found many inorganic compounds in such interlayers prevent image formation in an EAR element. This is illustrated in the following comparative examples. No answer to the problem of enhancing image formation in an electrically activatable recording layer by means of an inexpensive inorganic interlayer between an electrically conductive support and an electrically activatable recording layer in an EAR element was known in the prior art.

SUMMARY OF THE INVENTION

It has been found according to the invention that image formation is aided in an electrically activatable recording element comprising an electrically conductive support bearing (a) a first layer, and, contiguous to the first layer, (b) an electrically activatable recording layer, by a first layer (a) which is an inorganic layer consisting essentially of a compound selected from the group consisting of silver chlorides, silver bromides, silver iodides, transition metal bromides and chlorides, alkali metal chlorides, bromides and iodides, mixed chlorides, bromides and iodides of such metals, and combinations of such compounds. The inorganic layer (a) herein is designated as an inorganic conductive enhancing interlayer (ICEI).

It has also been found according to the invention that a developed image, preferably a dye image and silver image, such as a dye enhanced silver image, is produced in an EAR element according to the invention by (a) imagewise producing in the recording layer of the element a charge density sufficient to form a latent image in the recording layer, and then (b) developing the latent image, preferably by a dry development process, such as by heating the recording layer to a temperature and for a time sufficient to produce a dye image and silver image.

For example, it has been found that a dye image and silver image, is produced by a dry electrically activated recording process comprising the steps of (I) imagewise applying an electrical potential, of a magnitude and for a time sufficient to produce in the image areas a charge density within the range of about $10^{-2}$ coulomb/cm$^2$ to about $10^{-8}$ coulomb/cm$^2$ in an electrically activatable recording layer of an EAR element having an inorganic ICEI layer according to the invention, the charge density forming a latent image in the electrically activatable recording layer; and, then (II) heating the element substantially uniformly at a temperature and for a time sufficient to produce a dye image and silver image in the recording layer. In this process embodiment various means are useful to produce the desired charge density in the recording layer, such as a contact or non-contact electrode. For example, a corona ion current flow is useful to produce a developable image in the recording element.

The inorganic compounds in an ICEI layer of an EAR element according to the invention are advantageous because, in addition to enhancing image formation, they are easily prepared and are easily vapor deposited on the electrically conductive support without the need of a binder in the ICEI layer.

DETAILED DESCRIPTION OF THE INVENTION

Figure 1:
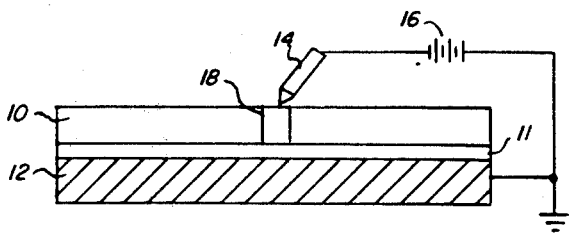
FIGS. 1 and 2 schematically illustrate an image recording material and process according to one embodiment of the invention.

The exact mechanisms by which the latent image is formed in the electrically activatable recording layer and by which the ICEI layer enables or enhances imaging in an element according to the invention are not fully understood. It is postulated that the injection of a charge carrier due to the electric field into the combination of components results in the formation of a latent image in the electrically activated recording layer.

The image forms in the exposed areas in the recording layer closest to the interface between the electrically activated recording layer and the ICEI layer rather than uniformly through the exposed areas of the electrically activated recording layer. It is believed that the development of the latent image is accomplished by a reaction in which the latent image catalyses the reaction of the described image-forming combination. In such a reaction the organic silver salt oxidizing agent reacts with the reducing agent. Then, the oxidized form of the reducing agent resulting from the reaction in turn reacts with a dye-forming coupler to produce a dye in the image areas.

While many image recording combinations containing the described components are useful, the optimum image recording combination and image recording element depends upon such factors as the desired image, particular dye-forming coupler, particular organic silver salt oxidizing agent and reducing agent, the source of exposing energy, processing condition ranges and particular ICEI layer.

The term "inorganic conductive enhancing interlayer" herein has been abbreviated as ICEI. This term describes a layer according to the invention which is located between the electrically activatable recording layer (the layer in which a latent image is formed) and the electrically conductive support of an element according to the invention. This ICEI layer is conductive because the image recording layer exhibits the desired image enhancement when electrical current is passed through the layers during imagewise exposure. The ICEI layer is differentiated from a layer that is merely electrically conductive because the ICEI layer influences image formation in the recording layer, whereas a layer that is merely electrically conductive does not influence the recording layer in such a manner.

The term "latent image" herein means an image that is not visible to the unaided eye or is faintly visible to the unaided eye and that is capable of amplification in a subsequent processing step, especially in a subsequent heat development step.

The term "electrically conductive" such as in "electrically conductive support" or "electrically conductive interlayer" herein means a material that has a resistivity less than about $10^{12}$ ohm-cm.

The inorganic compounds in an ICEI layer according to the invention are prepared by methods known in the inorganic synthesis art. The method of preparation is selected which produces an inorganic compound having the most useful physical and chemical properties, such as desired vaporization properties.

The following compounds are examples of preferred inorganic compounds for an ICEI layer according to the invention: silver chloride, silver bromide, silver iodide, platinum bromide, iridium bromide, osmium bromide, palladium bromide, rhenium bromide, ruthenium bromide, nickel bromide, cobalt bromide, iron bromide, platinum chloride, iridium chloride, osmium chloride, palladium chloride, rhenium chloride, ruthenium chloride, nickel chloride, cobalt chloride, iron chloride, sodium chloride, potassium chloride, rubidium chloride, cesium chloride, sodium bromide, potassium bromide, rubidium bromide, cesium bromide, sodium iodide, potassium iodide, rubidium iodide, cesium iodide. Examples of mixed halides of such metals include silver chlorobromide, silver bromoiodide, silver chlorobromide, silver chloroiodide, silver bromoiodide and rubidium silver iodide. Combinations of such metals are also useful.

The ICEI layer is preferably prepared by vapor depositing at least one of the inorganic compounds on a conductive layer for support. Vapor depositing methods are known in the photographic art and include those described in, for example, U.S. Pat. No. 3,316,096.

Many photoconductors are useful in an element according to the invention. Selection of an optimum photoconductor depends upon such factors as the particular electrically activatable recording layer, the charge sensitivity of the element, the desired image, ohmic resistivity desired, exposure means, processing conditions and particular inorganic compound for the ICEI layer. It is advantageous to select a photoconductor which has the property of being most useful with the operative voltages for imaging. The photoconductor is either an organic photoconductor or an inorganic photoconductor. Combinations of photoconductors are useful. The resistivity of the photoconductor can change rapidly in the operating voltage ranges that are useful. In some cases it is desirable that the photoconductive layer have persistant conductivity. Examples of useful photoconductors include lead oxide, cadmium sulfide, cadmium selenide, cadmium telluride and selenium. Useful organic photoconductors include, for example, polyvinyl carbazone/trinitrofluoronone photoconductors and aggregate type photoconductors described in, for example, U.S. Pat. No. 3,615,414. These photoconductors are known in the image recording art and are described in, for example, U.S. Pat. No. 3,577,272; *Research Disclosure,* August, 1973, Item No. 11210; and "Electrophotography" by R. M. Schaffert (1975).

An illustrative photoconductive layer comprises a dispersion of a lead oxide photoconductor in an insulating binder, such as a binder comprising a polycarbonate (for example, LEXAN, a trademark of the General Electric Company, U.S.A. consisting of a bisphenol A polycarbonate), polystyrene or poly(vinyl butyral).

Many dye-forming couplers are useful in an electrically activatable recording element and process of the invention. The exact mechanism by which the dye image and silver image are produced is not fully understood. It is believed that the dye-forming coupler reacts with the oxidized form of the reducing agent to form a dye. The term dye-forming coupler herein means a compound or combination of compounds which with other of the components, produces a desired dye image upon heating the recording layer after exposure. Dye-forming couplers are known in the photographic art as color-forming couplers. Selection of an optimum dye-forming coupler is influenced by such factors as the desired dye image, other components of the recording layer, processing conditions, particular reducing agent in the recording layer, and the binder in the recording layer. Useful cyan, magenta and yellow dye-forming couplers are selected from, for example, those described in, for instance, "Neblett's Handbook of Photography and Reprography" edited by John M. Sturge, 7th Edition, 1977, pages 120–121 and *Research Disclosure,* December, 1978, Item No. 17643. An example of a useful magenta dye-forming coupler is 1-(2,4,6-trichlorophenyl)-3-[3-]α-(3-pentadecylphen-oxy)-butyramido]-benzimido]-5-pyrazol one. A useful cyan dye-forming coupler is 2,4-dichloro-1-naphthol. A useful yellow dye-forming coupler is α-[3-]α-(2,4-di-tertiaryamylphenoxy)acetamido[benzoyl]-2-fluoroacetanilide.

An especially useful dye-forming coupler is a resorcinol dye-forming coupler. The resorcinol dye-forming coupler is preferable because many resorcinol dye-forming couplers produce a neutral (black) or nearly neutral appearing dye with the oxidized form of the described reducing agent. Examples of useful resorcinol dye-forming couplers are described in *Research Disclosure,* September, 1978, Item No. 17326 and U.K. Published Application 2018453A. Preferred resorcinol dye-forming couplers include 2′,6′-dihydroxyacetanilide and 2′,6′-dihydroxytrifluoroacetanilide. Another useful resorcinol dye-forming coupler is 2′,6′-dihydroxy-2,5-dimethylbenzanilide. Resorcinol dye-forming couplers are prepared by procedures known in the chemical arts.

The dye-forming coupler is useful in a range of concentrations in the electrically activatable recording layer. Selection of an optimum concentration of dye-forming coupler will depend upon such factors as the particular coupler, the desired image, processing conditions, other components in the recording layer and the particular reducing agent in the recording layer. The recording layer contains a concentration of dye-forming coupler that is generally within the range of about 0.1 to about 1.0 mole of dye-forming coupler per mole of total silver in the recording layer. A preferred concentration of dye-forming couplers is within the range of about 0.25 to about 0.75 mole of dye-forming coupler per mole of total silver in the recording layer.

Useful organic silver salt oxidizing agents are silver salts of 1,2,4-mercaptotriazole derivatives in the recording layer. Useful silver salts of 1,2,4-mercpatotriazole derivatives include those represented by the formula:

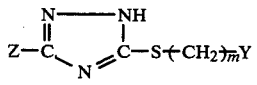

wherein

Y is aryl containing 6 to 12 carbon atoms, such as phenyl, naphthyl and para-chlorophenyl;

m is 0, 1 or 2; and

Z is hydrogen, hydroxyl or amine ($-NH_2$).

Preferred organic silver salt oxidizing agents within this class are those silver salts of the 1,2,4-mercaptotriazole derivatives wherein Y is phenyl, naphthyl or para-chlorophenyl; and Z is amine.

An example of such a compound is the silver salt of 3-amino-5-benzylthiol-1,2,4-triazole (referred to herein as ABT). Such organic silver salt oxidizing agents are desdribed in, for instance, U.S. Pat. No. 4,123,274 and U.S. Pat. No. 4,128,557. Elements containing these organic silver salt oxidizing agents produce higher speeds than similar elements containing silver behenate or other organic silver salt oxidizing agents.

Combinations of organic silver salt oxidizing agents are also useful. An example of a combination of organic silver salt oxidizing agents is the combination of the silver salt of ABT with the silver salt of 1-methyl-4-imidazoline-2-thiol. Other combinations include the combinations of the silver salt of ABT with the silver salts of nitrogen acids described in, for example, U.S. Pat. No. 4,220,709.

Selection of an optimum organic silver salt oxidizing agent or combination of organic silver salt oxidizing agents will depend upon such factors as the desired image, particular reducing agent, particular dye-forming coupler, processing conditions, and particular binder in the recording layer. A preferred organic silver salt oxidizing agent is the silver salt of ABT.

The organic silver salt oxidizing agent or combination of organic silver salt oxidizing agents are useful in a range of concentrations in the recording layer of an electrically activatable recording element according to the invention. Selection of an optimum concentration of organic silver salt oxidizing agent or combination of organic silver salt oxidizing agents depends upon the described factors, such as the desired image, particular reducing agent, particular dyeforming coupler, processing conditions and particular binder in the electrically activatable recording layer. A preferred concentration of organic silver salt oxidizing agent or combination of silver salt oxidizing agents is within the range of about 0.1 mole to about 2.0 moles of silver salt oxidizing agent per mole of reducing agent in the recording layer. For instance, when the organic silver salt oxidizing agent is the silver salt of ABT, a preferred concentration of organic silver salt oxidizing agent is within the range of about 0.1 to about 0.2 moles of organic silver salt oxidizing agent per mole of reducing agent in the recording layer.

Preparation of the organic silver salt oxidizing agent is preferably not carried out in situ, that is, not in combination with other components of the recording layer. Rather, the preparation of the oxidizing agent is preferably carried out ex situ, that is, separate from other components of the recording layer. In most instances, the preparation of the organic silver salt oxidizing agent will be separate from the other components based on the ease of control of preparation and storage capability.

The term "salt" herein includes any type of bonding or complexing mechanism which enables the resulting material to produce desired image properties in the recording layer of an element according to the invention. The term "salt" includes what are known in the chemical arts as "complexes", for example, neutral complexes and non-neutral complexes.

Many reducing agents which, in their oxidized state, form a dye with the dye-forming coupler, are useful in the recording element according to the invention. The reducing agent is preferably an organic silver halide color developing agent. Combinations of reducing agents are useful. It is important that the reducing agent produces an oxidized form upon reaction with the organic silver salt oxidizing agent which reacts at processing temperature with the dye-forming coupler to produce a desired dye. Preferred reducing agents are primary aromatic amines including, for example, paraphenylenediamines. Examples of useful reducing agents which are primary aromatic amines include:

4-amino-N,N-dimethylaniline;

4-amino-N,N-diethylaniline;

4-amino-3-methyl-N,N-diethylaniline (also known as N,N-diethyl-3-methyl-paraphenylenediamine);

4-amino-N-ethyl-N-β-hydroxyethylaniline;

4-amino-3-methyl-N-ethyl-N-β-hydroxyethylaniline;

4-amino-3-methoxy-N-ethyl-N-β-hydroxyethylaniline;

4-amino-N-butyl-N-gammasulfobutylaniline;

4-amino-3-methyl-N-ethyl-N-β-sulfoethyl-aniline;

4-amino-3-β-(methanesulfonamido)ethyl-N,N-diethylaniline;

4-amino-3-methyl-N-ethyl-N-β-(methanesulfonamido)ethylaniline; and 4-amino-3-methyl-N-ethyl-N-β-methoxyethylaniline.

The term "reducing agent" herein includes compounds which are reducing agent precursors in the recording layer. That is, those compounds which are not reducing agents in the recording layer until a condition occurs, such as heating of the recording layer are included.

A preferred reducing agent is one that consists essentially of a para-phenylenediamine silver halide developing agent that exhibits an E ½ value in aqueous solution at pH 10 within the range of −25 to +175 millivolts versus SCE. The term "E ½ value" herein means half wave potential. The term "SCE" herein means saturated calomel electrode. These values are determined by analytical procedures known in the photographic art and described in, for example, the text "The Theory of the Photographic Process" 4th edition, edited by T. H. James, 1977, pgs. 318–319.

The described reducing agent is useful in a range of concentrations in an element according to the invention. Selection of an optimum concentration of reducing agent or a combination of reducing agents depends upon such factors as the desired image, particular organic silver salt oxidizing agent, particular dye-forming coupler, processing conditions and the particular polymer in the EAC layer. A preferred concentration of reducing agent or combination of reducing agents is within the range of about 0.1 to about 5.0 moles of reducing agent per mole of organic silver salt in the recording layer. An especially useful concentration of reducing agent is within the range of about 0.2 to about 2 moles of reducing agent per mole of organic silver salt in the recording layer.

The tone of the combined silver image and dye image produced according to the invention varies depending upon such factors as the silver morphology of the developed silver image, covering power of the silver materials, particular dye-forming coupler, particuar developing agent, and processing conditions. In recording layers that produce a brown silver image, the hue of the dye image produced is preferably complimentary in hue to the silver image. An image hue of the combined dye image and silver image is preferably neutral.

The term "neutral" herein includes hues which occasionally are described in the photographic art as blue-black, gray, purple-black, black and the like. Whether or not a given hue is "neutral" is readily determined by visual inspection with the unaided eye.

Procedures for determining whether or not an image is "neutral" are known in the photographic art and described in, for example, *Research Disclosure,* September 1978, Item No. 17326.

Many colloids and polymers, alone or in combination, are useful as vehicles and binding agents in the layers of an electrically activatable recording element according to the invention. These vehicles and binding agents are in various layers of the element, especially in the recording layer. Suitable materials are hydrophobic or hydrophilic. It is necessary that the vehicle or binder in the element not substantially adversely affect the charge sensitivity or ohmic resistivity of the element. It is also necessary that the vehicle or binder be compatible with the ICEI layer. The selection of an optimum colloid or polymer or combination of colloids or polymers depends upon such factors as the desired charge sensitivity, desired ohmic resistivity, desired image, particular processing conditions, and particular EAC layer. Useful colloids and polymers are transparent or transluscent and include naturally occuring substances such as proteins, for example, gelatin, gelatin derivatives, cellulose derivatives, and polysaccharides, such as dextran. Synthetic polymers are preferred due to their desired charge sensitivity properties and ohmic resistivity properties. Useful polymeric materials for this purpose include polyvinyl compounds, such as poly(vinylpyrrolidone), acrylamide polymers and dispersed vinyl compounds such as in latex form. Effective polymers include water insoluble polymers of alkyl acrylates and methacrylates containing minor concentrations of acrylic acid, sulfoalkylacrylates or methacrylates and those which have crosslinking sites which facilitate hardening or curing. Preferred polymers are high molecular weight materials and resins which are compatible with the components of the element. These include, for example, poly(vinylbutyral), cellulose acetate butyrate, poly(methylmethacrylate), poly(vinylchloride), ethylcellulose, polystyrene, poly(isobutylene), butadiene-styrene copolymers, vinylchloride-vinylacetate copolymers, copolymers of vinylacetate, vinylchloride and maleic acid and poly(vinyl alcohol). Combinations of colloids and polymers are useful depending upon the described factors. Highly preferred binders include polyacrylamide, as well as copolymers of acrylamide and other vinyl addition monomers such as copolymers of acrylamide and vinylimidizole or copolymers of acrylamide and N-methylacrylamide.

An overcoat layer is optionally useful on the recording layer according to the invention. It is important that the overcoat layer, if present, not adversely affect the desired charge sensitivity and ohmic resistivity properties of the element. Such an overcoat layer reduces fingerprinting and abrasion marks before and after exposure and processing. The overcoat layer is one or more of the described polymers which are useful as binders. These materials are required to be compatible with other components of the element and must be able to tolerate the processing temperatures which are useful for developing the described images.

It is generally unnecessary to have a photosensitive component present in the electrically activatable recording element. It is unnecessary that the ICEI layer be a photosensitive inorganic compound. A photosensitive component herein means any photosensitive material, especially a photosensitive metal salt or complex, which produces developable nuclei upon light exposure. If a photosensitive component is present in the recording layer, a preferred photosensitive metal salt is photosensitive silver halide due to its desired properties in forming developable nuclei upon charge exposure. A preferred concentration of photosensitive metal salt is within the range of about 0.001 to about 10.0 moles of photosensitive metal salt per mole of organic silver salt in the element. A preferred photosensitive silver halide is silver chloride, silver bromide, silver bromoiodide or mixtures thereof. For purposes of the invention, silver iodide is also considered to be a photosensitive silver halide. Very fine grain photographic silver halide is useful although a range of grain size from fine grain to coarse grain photographic silver halide is suitable in the recording layer. The photosensitive silver halide is prepared by any of the procedures known in the photographic art. Such procedures and forms of photosensitive silver halide are described in, for example, *Research Disclosure,* December 1978, Item No. 17643. The photosensitive silver halide is washed or unwashed, is chemically sensitized if desired by means of chemical sensitization procedures known in the art, and is protected against the production of fog and stabilized against loss of sensitivity during keeping as described in the above Research Disclosure publication.

If a photosensitive component is present in the electrically activatable recording layer, the described image-forming combination enables a lower concentration of the photosensitive component than otherwise would be expected in a photosensitive element. This lower concentration is enabled by the amplification affect of the image-forming combination, as well as the formation of developable nuclei, in addition to the dye enhancement of the silver image formed.

The electrically activatable recording element according to the invention optionally contains addenda which aid in producing a desired image. These addenda include, for example, development modifiers that function as speed increasing compounds, hardeners, plasticizers and lubricants, coatings aids, brighteners, spectral sensitizing dyes, absorbing and filter dyes. These addenda are described in, for example, *Research Disclo-*

*sure,* December 1978, Item No. 17643 and U.S. Pat. No. 4,234,670.

A post-processing stabilizer or stabilizer precursor is optionally present in the recording layer to increase post-processing stability of the developed image. The recording layer following processing generally is sufficiently stable to avoid the need for incorporation of a stabilizer or stabilizer precursor in the recording layer. In the case of recording materials which contain photosensitive silver halide, such a stabilizer or post-processing stabilizer precursor is optionally included to provide increased post-processing stability. Many stabilizers and stabilizer precursors are useful in elements according to the invention containing photosensitive silver halide. These stabilizers and stabilizer precursors are useful alone or in combination. Useful stabilizers and stabilizer precursors include, for instance, photolytically active polybrominated organic compounds. Thioethers or blocked azolinethiones stabilizer precursors are also useful.

When a stabilizer or stabilizer precursor is present in the electrically activatable recording element according to the invention, a range of concentrations of stabilizer or stabilizer precursor is useful. The optimum concentration of stabilizer or stabilizer precursor depends upon such factors as the particular element, processing conditions, particular stabilizer or stabilizer precursor, and desired stability of the developed image. A preferred concentration of stabilizer or stabilizer precursor is within the range of about 1 to about 10 moles of stabilizer or stabilizer precursor per mole of photosensitive component in the element.

It is often advantageous to include a heat sensitive base release agent or base precursor in the recording element according to the invention to produce improved and more effective image development. A base release agent or base precursor herein includes compounds which upon heating in the recording layer produce a more effective reaction between the described components of the image-forming combination and produce improved reaction between the oxidized form of the described reducing agent and the dye-forming coupler. Examples of useful heat sensitive base release agents or base precursors are aminimide base release agents, such as described in *Research Disclosure,* May 1977, Item Nos. 15733, 15732, 15776 and 15734; guanidinium compounds, such as guanidinium trichloroacetate and other compounds which are known in the photothermographic art to release a base moiety upon heating, but do not adversely affect the desired properties of the recording element. Combinations of heat sensitive base release agents are useful.

A heat sensitive base release agent or base precursor or combination of such compounds is useful in a range of concentrations in the elements according to the invention. The optimum concentration of heat sensitive base release agent or base precursor depends upon such factors as the desired image, particular dye-forming coupler, particular reducing agent, other components in the image-forming element, processing conditions and the like. A preferred concentration of base release agent is generally within the range of about 0.25 to about 2.5 moles of base release agent or base precursor per mole of reducing agent in the recording layer.

Any electrically conductive support is useful in an electrically activatable recording element according to the invention. The term "electrically conductive support" herein means (a) supports that are electrically conductive without the need for separate addenda in the support or on the support to produce the desired degree of electrical conductivity and (b) supports that comprise addenda or separate electrically conductive layers that enable the desired degree of electrical conductivity. Useful supports include cellulose ester, poly(vinylacetal), poly(ethylene terephthalate), polycarbonate and polyester film supports and related films and resinous materials. Other supports are useful, such as glass, paper, metal and the like which withstand the processing temperatures and do not adversely affect the charge sensitivity and ohmic resistivity which are desired in the element. A flexible support is generally most useful. An example of a preferred electrically conductive support is a poly(ethylene terephthalate) film having a polymeric subbing layer, such as a poly(methylacrylate-co-vinylidene chloride-co-itaconic acid) subbing layer and having a layer of cermet on the subbing layer.

The electrically activatable recording element according to the invention generally includes an electrically conductive layer positioned between the support and the ICEI layer. This is illustrated by electrically conductive layer 55 in FIG. 5. The electrically conductive layers, as described, such as layers 62 and 55 in FIG. 5 comprise a variety of electrically conducting compounds which do not adversely affect the charge sensitivity and ohmic resistivity of an element according to the invention. Examples of useful electrically conductive layers include layers comprising an electrically conductive chromium composition such as cermet and nickel, copper, cuprous iodide and silver.

Figure 5:
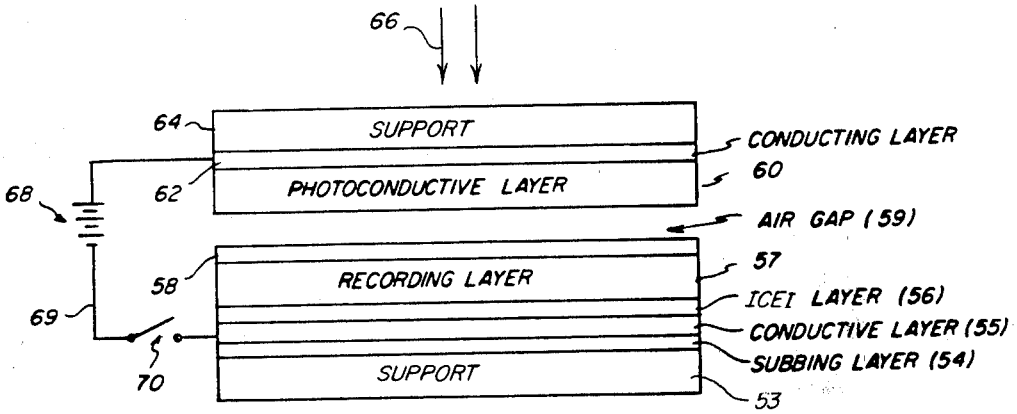
FIG. 5 illustrates schematically an image recording material that is very useful according to the invention.

In some embodiments of the invention, the photoconductive layer is a self-supporting layer, such as a photoconductor in a suitable binder. In such embodiments, an electrically conductive layer such as an electrically conductive nickel or chromium composition layer is coated on the photoconductive layer. This is illustrated in, for example, FIG. 3 in the drawings, in which electrically conductive layer 28 is on photoconductive layer 30 which is self-supporting. Optionally, the photoconductive layer is coated on an electrically conductive support such as illustrated in FIG. 5 of the drawings.

The described layers are coated by coating procedures known in the photographic art including vacuum deposition, dip coating, air knife coating, curtain coating or extrusion coating using hoppers known in the photographic art. Two or more layers are optionally coated simultaneously.

The various components of the electrically activatable recording element are prepared for coating by mixing the components with suitable solutions or mixtures including suitable organic solvents, depending on the particular electrically activatable recording material and the components. The components are added and mixed by means of procedures known in the photographic art.

Preferred electrically activatable recording elements comprise an electrically conductive support having thereon an electrically activatable recording layer which has a thickness within the range of about 1 to about 30 microns, preferably within the range of about 2 to about 15 microns. The optimum layer thickness of each of the layers of an element according to the invention will depend upon such factors as the particular ohmic resistivity desired, charge sensitivity, particular components of the layers and the desired image.

The ICEI layer, such as layer 56 illustrated in FIG. 5, preferably has a thickness within the range of about 0.005 to about 0.50 micron, such as within the range of about 0.025 to about 2.0 microns. The optimum layer thickness of the ICEI layer depends upon such factors as the particular ohmic resistivity desired, charge sensitivity, desired image and the particular electrically activatable recording layer.

A "melt-forming compound" is useful in the recording layer to produce an improved developed image. A "melt-forming compound" is preferred with recording materials containing silver salts of nitrogen acids. The term "melt-forming compound" herein means a compound which upon heating to the described processing temperature produces an improved reaction medium, preferably a molten medium, wherein the described image-forming combination produces a desired image upon development. It is believed that at the reaction temperature, a melt occurs which permits the reaction components to better interact. If desired, a melt-forming compound is included with other components of the recording layer prior to coating on the support. Examples of useful melt-forming compounds include succinimide, dimethylurea, sulfamide, acetamide and resorcinol.

The organic silver salt oxidizing agent in the recording layer contains a range of ratios of the organic moiety to silver ion. The optimum ratio of the organic moiety to silver ion in the organic silver salt oxidizing agent depends upon such factors as the particular organic moiety, the particular concentration of silver ion desired, processing conditions, and the particular dye-forming coupler. The molar ratio of organic moiety to silver as silver ion in the salt is generally within the range of about 0.5:1 to about 3:1.

The image recording layer of the invention has a range of pAg. The pAg is measured by means of conventional calomel and silver-silver chloride electrodes, connected to a commercial digital pH meter. Preferably the pAg in a dispersion containing the described components for the recording layer is within the range of about 2.5 to about 7.5. The optimum pAg depends upon the described factors, such as the desired image, processing conditions and the particular EAC layer.

A recording material containing the organic silver salt oxidizing agent preferably has a pH that is within the range of about 1.5 to about 7.0. A preferred pH for the recording layer is within the range of about 2.0 to about 6.0.

The desired resistivity characteristics of an electrically activatable recording element according to the invention are obtained by separately measuring the current-voltage characteristic of each sample coating at room temperature by means of a mercury contact on the surface of the coating. To eliminate the possibility that a micro thickness surface air gap might affect the measured resistivity, exposures are made with an evaporated metal (bismuth or aluminum) electrode on the surface of an electrically activatable recording layer to be tested. The resistivity is measured at various ambient temperatures. The data is measured at a voltage within the range of, for example, $10^2$ volts to $10^5$ volts/cm, which is within the ohmic response range of the recording layer to be tested. It is expected that the resistivity of the recording layer varies widely with temperature. It is also expected that the dielectric strength of the layer varies with temperature.

An illustrative embodiment of the invention comprises an electrically activatable recording element preferably having an ohmic resistivity of at least about $10^7$ ohm-cm, comprising in sequence:

(a) a first electrical conducting layer,
(b) a photoconductive layer,
(c) an electrically activatable recording layer separated from (b) by an air gap of up to about 20 microns or separated from (b) by an electrically conductive interlayer and comprising, in reactive association:
  (A) a dye-forming coupler consisting essentially of a resorcinol coupler such as 2′,6′-dihydroxytrifluoroacetanilide,
  (B) an image-forming combination consisting essentially of
    (i) an organic silver salt oxidizing agent consisting essentially of a silver salt of 3-amino-5-benzylthio-1,2,4-triazole, with
    (ii) a reducing agent consisting essentially of a phenylenediamine silver halide developing agent, such as 4-amino-2-methoxy-N,N,5-trimethylaniline sulfate, and
  (C) a polyacrylamide binder,
(d) ICEI layer consisting essentially of $RbAg_4I_5$ or AgBr,
(e) a second electrical conducting layer, on
(f) a support.

Many energy sources are useful for imagewise exposure of a recording element of the invention. Selection of an optimum energy source for imagewise exposure depends upon such factors as the sensitivity of the recording layer, sensitivity of the photoconductor, the particular image recording combination in the electrically activatable recording layer, desired image and processing conditions. Useful energy sources for imagewise exposure include for example, visible light, x-rays, lasers, electron beams, ultraviolet radiation, infrared radiation and gamma rays. The electrically activatable recording layer is also sensitive to direct electrical contact by means of a contact electrode, such as a stylus.

An illustrative process according to the invention which produces a dye image and silver image comprises the steps:

(I) imagewise altering the conductivity of the photoconductive layer of the electrically activatable recording element according to the invention in accord with an image to be recorded;
(II) applying across the photoconductive layer and the recording layer an electrical potential of a magnitude and for a time sufficient to produce a developable latent image in the recording layer corresponding to the image to be recorded; and then
(III) heating the recording layer substantially unformly at a temperature and for a time sufficient to produce a dye image and a silver image, preferably a dye-enhanced silver image, in the recording layer.

The step (I) of imagewise altering the conductivity of the photoconductive layer is preferably carried out while simultaneously (II) applying the described electrical potential across the photoconductive layer and recording layer.

A further illustrative process of the invention is an electrically activated recording process for producing a dye image and silver image, preferably a dye-enhanced silver image, in an electrically activated recording element, having an ICEI layer according to the invention, comprising the steps:

(I) imagewise altering the conductivity of a photoconductive layer in accord with an image to be recorded;

(II) positioning the imagewise altered photoconductive layer from (I) in face-to-face relationship with an electrically activatable recording layer of the recording element;

(III) applying across the photoconductive layer and the recording layer, an electrical potential of a magnitude and for a time sufficient to produce in the areas of the recording layer corresponding to the imagewise altered portions of the photoconductive layer, a current density within the range of about $10^{-5}$ coulomb/cm$^2$ to about $10^{-8}$ coulomb/cm$^2$, the current density forming in the image areas a developable latent image; and then (IV) uniformly heating the recording element at a temperature and for a time sufficient to produce a dye image and silver image, preferably a dye-enhanced silver image, in the recording element.

Another illustrative process of the invention is a dry electrically activated recording process for producing a dye image and silver image, preferably a dye-enhanced silver image, in an electrically activatable recording element having an ICEI layer according to the invention, preferably having an ohmic resistivity within the range of about $10^4$ to about $1\times10^{12}$ ohm-cm, containing at least one electrically activatable recording material comprising in a suitable binder, such as polyacrylamide, (A) a dye-forming coupler, and (B) an image-forming combination comprising:

(i) an organic silver salt oxidizing agent, preferably a silver salt of a 1,2,4-mercaptotriazole derivative, with (ii) a reducing agent which, in its oxidized form, forms a dye with the dye-forming coupler; comprising the steps:

(I) positioning the recording material on an electrically conductive backing member;

(II) modulating a corona ion current flow to the recording element by an electrostatic field established imagewise between an image grid comprising an electroconductive core sequentially connectable to sources of different potential relative to the backing member and covered with a coating of a photoconductive insulating material and a control grid that is electrically conductive and sequentially connectable to sources of different potential relative to the backing member, said current flow being of a magnitude sufficient to produce a current density within the range of about $10^{-5}$ to about $10^{-8}$ coulomb/cm$^2$ imagewise in the recording element, which current density forms a developable latent image in the electrically activated recording material; and, then (III) substantially uniformly heating the recording element at a temperature and for a time sufficient to produce a dye image and silver image in the recording element.

A preferred process embodiment of the invention is a dry electrically activated recording process for producing a dye-enhanced silver image in an electrically activatable recording element, preferably having an ohmic resistivity of at least about $10^4$ ohm-cm, comprising, in sequence, a support having thereon:

(a) a first electrically conductive layer, (b) an organic photoconductive layer, (c) an electrically activatable recording layer separated from (b) by an air gap of up to 20 microns or separated from (b) by an electrically conductive interlayer, and comprising:

(A) a dye-forming coupler consisting essentially of 2,6-dihydroxyacetanilide and 2',6'-dihydroxytrifluoroacetanilide and combinations thereof, (B) an image-forming combination comprising:

(i) an organic silver salt oxidizing agent consisting essentially of a silver salt of 3-amino-5-benzylthio-1,2,4-triazole, with (ii) a reducing agent consisting essentially of a phenylenediamine silver halide developing agent, such as 4-amino-2-methoxy-N,N,5-trimethylanilinesulfate, and (iii) a polyacrylamide binder, (d) an ICEI layer of the invention, such as a $RbAg_4I_5$ or AgBr layer, and (e) a second electrically conductive layer; said process comprising the steps:

(I) imagewise altering the conductivity of the photoconductive layer in accord with an image to be recorded while simultaneously (II) applying across the photoconductive layer and recording layer an electrical potential of a magnitude and for a time sufficient to produce a developable latent image in the recording layer; and then (III) heating the recording layer substantially uniformly at a temperature and for a time sufficient to produce a dye-enhanced silver image in the recording layer.

An imagewise current flow is produced through the electrically activatable recording layer and the ICEI layer according to the invention. Although a particular technique to produce an imagewise current flow has been described, preferred techniques are those which include use of a photoconductive layer as an image-to-current converter or use of a direct contact electrode to produce sufficient current to enable formation of a latent image. The imagewise current flow is, for example, optionally provided by contacting the electrically activatable recording element with a suitable electrostatically charged means such as an electrostatically charged stencil or scanning the recording element by means of a beam of electrons.

Heating the electrically activatable recording element after latent image formation is carried out by techniques and by means known in the photothermographic art. For example, heating is carried out by passing the imagewise exposed recording element over a heated platen or drum or through heated rolls, by heating the element by means of microwaves, dielectric heating means, or heated air. A visible image is produced in the described exposed element within a short time, such as within about 1 to about 90 seconds by the described heating step. An image having a maximum transmission density of at least 1.0 and preferably at least 1.5 is produced according to the invention. For example, the recording element is uniformly heated to a temperature within the range of about 100° C. to about 200° C. until a desired image is developed, typically within about 2 to about 90 seconds. The imagewise exposed material is preferably heated to a temperature within the range of about 120° C. to about 180° C. The optimum temperature and time for processing will depend upon such factors as the desired image, the particular recording element and heating means.

The electrically activatable recording element and process according to the invention are useful for producing multiple copies. According to this embodiment, multiple copies are prepared by a dry electrically activated recording process for producing a dye image and silver image, preferably a dye-enhanced silver image, in an electrically activatable recording element comprising the steps of:

(I) imagewise altering the conductivity of a photoconductive layer in accord with an image to be recorded;

(II) positioning the imagewise altered photoconductive layer from step (I) adjacent an electrically activatable recording layer of the invention, (III) applying an electrical potential across the photoconductive layer and recording layer of a magnitude and for a time sufficient to produce in the areas of the recording layer corresponding to the imagewise altered portions of the photoconductive layer a current density within the range of about $10^{-5}$ to about $10^{-8}$ coulomb/cm$^2$, the current density forming in the areas a developable latent image; then (IV) uniformly heating the recording element at a temperature and for a time sufficient to produce a dye image and silver image, preferably a dye-enhanced silver image, in the recording element; followed by (V) positioning the imagewise altered photoconductive layer adjacent a second electrically activatable recording layer, preferably having an ohmic resistivity of at least about $10^7$ ohm-cm; then (VI) applying an electrical potential across the photoconductive layer and the second recording layer of a magnitude and for a time sufficient to produce in the areas of the image of the photoconductive layer a current density within the range of about $10^{-5}$ to about $10^{-8}$ coulomb/cm$^2$, the charge density forming a developable latent image; then (VII) uniformly heating the second recording layer at a temperature and for a time sufficient to produce a developed image in the second recording layer.

While the exact mechanism of image formation upon heating is not fully understood, it is believed that the imagewise exposure to current provides nuclei in the image areas of the recording layer. Such nuclei apparently increase the reaction rate and act as catalysts for the reaction between the organic silver salt oxidizing agent and the reducing agent. It is believed that the nuclei enable a form of amplification which would not otherwise be possible. The organic silver salt oxidizing agent and reducing agent are in a location with respect to each other which enables the nuclei formed to provide the desired catalytic effect. The organic silver salt oxidizing agent and reducing agent as well as the dye-forming coupler are in reactive association in the electrically activatable recording layer. The term "in reactive association" means that the nuclei resulting from the imagewise exposure are in a location with respect to the other components which enables desired catalytic activity. Such reactive association also enables more useful dye images and silver images.

Figure 2:
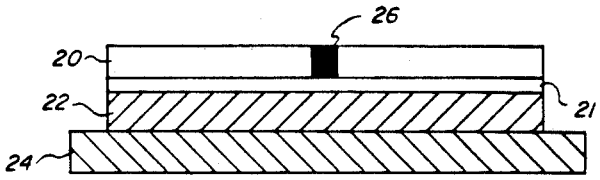

Referring to the drawings, embodiments of the invention are depicted schematically in FIGS. 1 and 2. According to the embodiment illustrated in FIGS. 1 and 2 an electrically activatable recording layer 10 having an ICEI layer 11 according to the invention is placed on a grounded electrically conductive backing or support 12. A current is selectively applied to the recording layer 10 by the point of a metal stylus 14 which is raised to a sufficiently high voltage relative to the support 12 by a voltage source 16 and brought into moving contact with the surface of the recording layer 10 containing the described image-forming combination and dye-forming coupler. Upon contacting the recording layer 10 with the stylus 14 a current flow is produced in the areas, such as area 18, of the recording layer contacted by the stylus. A developable latent image forms, that is a pattern of nuclei sites, in the pattern desired, as illustrated by area 18 in layer 10. The current density produced by the stylus in the contacted areas of the recording layer need not be sufficient to produce a visible image in the recording layer 10. The current density must be sufficient to product a latent image in the recording layer in those areas contacted by the stylus 14. Although a particular technique to produce an imagewise current flow through the recording layer 10 is illustrated in FIG. 1, techniques for producing an imagewise current flow generally known in the art of recording are useful and are intended to be encompassed by the description. The area of the recording layer 10 designated as 18 is intended to be illustrative of an area of nuclei sites formed upon contact of the stylus 14 with the recording layer 10. Other techniques for producing a nuclei pattern include, for example, scanning the layer 10 by means of a beam of electrons in an image pattern.

FIG. 2 illustrates development of the latent image formed in the recording element in FIG. 1 by, for example, moving the element from FIG. 1 into contact with a heated metal platen 24. The heat from platen 24 passes through the support 22 and ICEI layer 21 to the layer 20 containing the latent image to cause the desired reaction in the latent image area. The reaction in the latent image area causes development to produce a visible image 26 consisting essentially of a dye image and silver image, preferably a dye-enhanced silver image, in the recording layer 20. Upon development, the recording element is removed from the platen 24. No processing solutions or baths are required in this heat development step.

Figure 3:
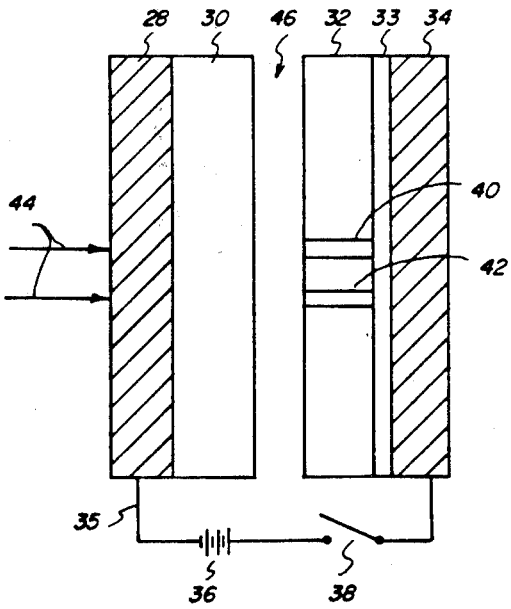
FIGS. 3 and 4 illustrate schematically an electrically activated recording process embodying the described invention.
Figure 4:
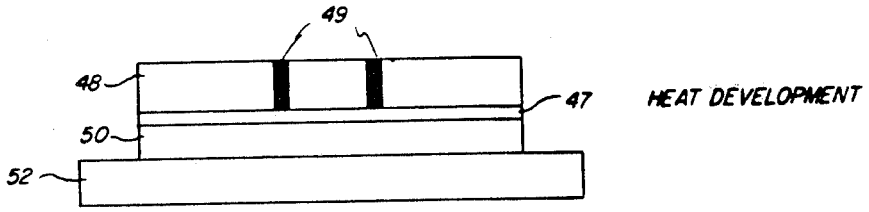

Another illustrative embodiment of the invention is schematically shown in FIGS. 3 and 4. In the embodiment in FIG. 3, the developable sites 40 and 42, that is the latent image sites, are formed by sandwiching a charge sensitive recording layer 32 and an image to current converter, layer 30, preferably a photoconductive layer, between a pair of electrically conductive layers 28 and 34. An ICEI layer 33 of the invention is present between electrically conductive layer 34 and recording layer 32. Layers 28 and 34 comprise suitable supports for layers 30, 32 and 33 or layers 28 and 34 are on separate suitable supports not shown, such as film supports. A high potential electric field, such as any voltage within the range of about 0.01 to about 6.0 Kv, is established across the photoconductive layer 30 and recording layer 32 by connecting the conductive layers 28 and 34 by connecting means 35 containing power source 36. The electric field across the layers is controlled by switch 38. The latent image formation at sites 40 and 42 is caused by imagewise exposing the photoconductive layer 30 through the conductor 28 to exposure means 44. Exposure means 44 generally comprises actinic radiation, preferably x-rays. The layer 28, and any support for layer 28, must be sufficiently transparent to the energy 44 to enable the energy to pass to a desired degree to photoconductive layer 30. The exposure selectively increases the conductivity of the photoconductive layer in those regions exposed to actinic radiation. When switch 38 is in a closed condition, thereby producing an electric field across the layers, an imagewise current flow is produced through the recording layer 32. The current flow occurs in those regions of the recording layer 32 only in position with the exposed portions of the photoconductive layer 30. An air gap 46 of up to 20 microns is provided between the layers 30 and 32. 46 may optionally comprise an electrically conductive interlayer, not shown, which does not adversely affect imaging. The air gap 46 is, for example, 1 to 20 microns. After a sufficient current density, preferably less than 10 microcoulomb/cm$^2$ has been produced in the current exposed portions of the recording layer 32, switch 38 is opened, thereby disrupting the current flow.

The described technique for application of voltage across the photoconductive and recording layers is illustrative. Techniques known in the recording art are useful and are intended to be included. For example, a grid-control corona discharge means, not shown, such as described in U.S. Pat. No. 3,370,212 is useful in place of the voltage source and conducting layer 28.

To develop the dye image and silver image in latent image sites 40 and 42, the recording element containing layers 32, 33 and 34 is moved away from the photoconductive layer 30. Connecting means 35 is also disconnected. The recording element illustrated in FIG. 4 is then contacted with a heating means such as a heated platen 52. The heat from the platen 52 passes through the support 50 and ICEI layer 47 to the layer 48 containing a latent image to produce a visible dye image and silver image 49. The heating is preferably carried out substantially uniformly by positioning the recording element in heat transfer relationship with the heated platen 52. After development of the silver image and dye image, the recording element is removed from the platen 52.

Another illustrative embodiment of the invention is illustrated in FIG. 5. In FIG. 5 the recording arrangement consists of a support 53 having thereon a polymeric subbing layer 54, such as a poly(alkylacrylate-co-vinylidene chloride-co-itaconic acid) subbing layer, having thereon an electrically conductive layer 55, preferably comprising cermet, and having thereon an ICEI layer 56 according to the invention. The subbing layer 54 helps the conductive layer 55 adhere to the support 53. A recording layer 57 is placed, such as by coating, on the ICEI layer 56. The recording layer 57 contains the image-forming combination and dye-forming coupler. An air gap 59, such as up to 20 microns is present between the overcoat layer 58 on recording layer 57 and photoconductive layer 60. The air gap 59 is optionally replaced by an electrically conductive interlayer that does not adversely affect image recording. The layer 60 is contiguous to an electrically conductive layer 62, such as a nickel layer, which is on a transparent film support 64.

Developable nuclei are formed in recording layer 57 by imagewise exposure by means of a suitable radiation source 66, such as a tungsten light source or x-ray source. At the time of imagewise exposure by means of the energy source 66, a high potential electric field, such as at a voltage within the range of about 0.01 to 6.0 Kv is established across the photoconductive and image recording layers by connecting the conductive layer 62 and electrically conductive layer 55 by connecting means 69 through a power source 68. The electric field across the layers is controlled by switch 70. After the necessary current density is established, switch 70 is opened, thereby disrupting the current flow. Imagewise exposure for about 1 to about 5 seconds at about 50 foot candles produces a developable image in recording layer 57. To develop the resulting latent image, layer 55 is disconnected from connecting means 69 and power source 68 and the element containing layer 57 is moved away from the photoconductive layer 60. The recording layer 57 is then heated uniformly by contacting it with a heated metal platen, not shown, until the desired dye image and silver image are produced.

A variety of binders and sensitizers known in the electrophotographic art are useful in the photoconductive layer, such as in layer 60 in FIG. 5. Useful binders are described in, for example, U.S. Pat. Nos. 2,361,019 and 2,258,423. Sensitizing compounds useful in the photoconductive layer are described in, for example, U.S. Pat. No. 3,978,335. In the embodiments illustrated which comprise an air gap between the photoconductive layer and image recording layer, the air gap distances are controlled by methods known in the art, such as by the roughness of the surface of the photoconductive layer as well as the roughness of the surface of the image recording layer. The air gap need not be uniform. Best results are observed when a uniform air gap exists between the photoconductive layer and the image recording layer.

The resistivity of a recording layer according to the invention is affected by the air gap effects. The number of variables affecting the resistance of the recording layer affects the choice of optimum recording materials and imaging means. The resistivity values described herein are for particular recording materials and are values measured under optimum temperature conditions during exposure.

If desired the recording element and imaging means according to the invention are modified to provide a continuous image recording operation. This is carried out by means of desired control circuitry and continuous transport apparatus not shown.

The following examples are included for a further understanding of the invention.

EXAMPLE 1

This illustrates the invention.

A poly(ethylene terephthalate) film having a subbing layer of poly(methylacrylate-co-vinylidene chloride-co-itaconic acid) was coated with a layer of cermet (electrically conductive SiO-Cr material) to form an electrically conductive support. Three portions, 25.4 centimeters by 12.2 centimeters, of the electrically conductive support were attached to a planetary substrate holder in a commercial vacuum coating system (Model LC18b manufactured by Consolidated Vacuum Products, Inc., U.S.A.). Powdered $RbAg_4I_5$ was placed in a vitreous carbon dimple boat clamped between two electrical feedthroughs in the vacuum coating system. The vacuum chamber was closed and evacuated to a pressure of $9.0\times10^{-6}$ torr (corresponding to $1.2\times10^{-3}$ Pa). The $RbAg_4I_5$ was melted by passing an electric current through the vitreous carbon boat. The $RbAg_4I_5$ when melted was heated to a temperature sufficient to vaporize the $RbAg_4I_5$ and deposit it on the electrically conductive support at a rate of about one angstrom per second. A coating of $RbAg_4I_5$ about 60 Å thick was permitted to form by vapor deposition on the electrically conductive support. Then the $RbAg_4I_5$ vapor source was permitted to cool to room temperature (about 20° C.), the vacuum chamber pressure was raised to atmospheric pressure and the electrically conductive supports containing the $RbAg_4I_5$ ICEI layer was removed from the chamber.

Subsequently an electrically activatable recording layer was coated on the $RbAg_4I_5$ layer. The electrically activatable recording layer was prepared by mixing and coating the following:

| | |
|---|---|
| silver complex of 3-amino-5-benzylthio-1,2,4-triazole (1.5:1 ligand/Ag ratio) (8% Ag by weight in 70% by volume water and 30% by volume ethanol) (organic silver salt oxidizing agent) | 16.0 ml |
| 3-methyl-5-mercapto-1,2,4-triazole (0.5% by weight in ethanol) (antifoggant) | 0.6 ml |
| Poly(acrylamide-co-1-vinylimidazole) (90:10 weight ratio) (8% by weight in water) (binder) | 0.25 ml |
| 2-methoxy-4-amino-5-methyl-N,N—dimethyl aniline monohydrate sulfuric acid salt (75 mg dissolved in 1 ml of water) (developing agent or reducing agent) | 1.0 ml |
| 4-phenyl-3-imino-5-thiourazole (0.5% by weight in ethanol) (imaging accelerator) | 0.6 ml |
| 2',6'-dihydroxytrifluoroacetanilide (128 mg dissolved in 1 ml of water) (coupler) | 1.0 ml |
| Surfactant (Surfactant 10G which is para-isononylphenoxypolyglycidol and is a trademark of and available from the Olin Corp., U.S.A.) (5% by weight in water) | 0.4 ml |
| $HgCl_2$ (1.0 mg dissolved in 0.25 ml of ethanol) (antifoggant) | 0.25 ml |

The electrically activatable recording layer was coated at a 355.6 micron (14 mils) wet coating thickness to provide 120–140 mg of silver/ft$^2$ (130–150 μg of silver/cm$^2$).

The photoconductive layer 60 (see FIG. 5) consisted of a 90 micron thick coating of tetragonal lead monoxide photoconductor. Electrically conductive layer 62 consisted of a transparent nickel coating. Support 64 was a poly(ethylene terephthalate) film support. The sandwich illustrated in FIG. 5 was imagewise exposed by means of a tungsten light source, not shown, of a silver test target. Imagewise exposure was for four seconds using a tungsten light source of a commercial sensitometer. During exposure a voltage of 1200 V was applied to the sandwich through connecting means 69 (switch 70 being in a closed condition) to layer 62 and layer 55. A positive polarity was applied to the photoconductive layer. The intensity and duration of imagewise exposure was sufficient to produce a developable latent image in layer 57.

After exposure, switch 70 was placed in an open condition and the portion of the element containing layer 57 was separated from the portion containing photoconductive layer 60. The layer 57 was then uniformly heated at 180° C. for 5 seconds by a heating means, not illustrated. A good quality negative reproduction of the original test object was produced in layer 57. The image had a maximum density of 1.0 and a minimum density of 0.20.

EXAMPLES 2–5

The procedure described in Example 1 was repeated with the exception that the $RbAg_4I_5$ in the ICEI layer was replaced by the halide listed in the ICEI column in following Table 2A. Also the light exposure time and voltage applied were as listed in Table 2A.

TABLE 2A

| Example No. | ICEI Compound | Exposure Time (Seconds) | Voltage | $D_{max}$ | $D_{min}$ |
|---|---|---|---|---|---|
| 2 | AgCl | 4 | +1600 | 1.20 | 0.20 |
| 3 | AgBr | 2 | +1600 | 1.15 | 0.20 |
| 4 | AgI | 6 | +1600 | 1.20 | 0.20 |
| 5 | KBr | 5 | +1200 | 0.90 | 0.20 |

The following examples are comparative examples.

EXAMPLE A

The procedure described in Example 1 was repeated with the exception that the $RbAg_4I_5$ in the ICEI layer was replaced by the compounds listed in the ICEI column in the following Table 3A. Each element had +900 volts applied across the sandwich. The light exposure time was as listed in Table 3A. In Examples A3 and A4 in Table 3A no cermet layer was present on the poly(ethylene terephthalate).

TABLE 3A

| Comparative Examples | ICEI (Layer Thickness in A) | Exposure Time (Seconds) | $D_{max}$ | $D_{min}$ |
|---|---|---|---|---|
| A1 | HgI (570) | 1.5 | 0.19 | 0.19 |
| A2 | Si (870) | 1.5 | 3.01 | 3.01 |
| A3 | CuI (1050) *(no cermet layer) | 1.5 | 0.70 | 0.70 |
| A4 | $RbAg_4I_5$ (97) *(no cermet layer) | (no charge) | 0.20 | 0.20 |
| A5 | HgCl (165) | 5.0 | 0.20 | 0.20 |
| A6 | LaOBr:Tm (135) | 5.0 | 1.87 | 1.87 |

None of the elements listed in Table 3A produced a useful image under the conditions of these examples.

The invention has been described in detail with particular reference to preferred embodiments thereof, but it will be understood that variations and modifications can be effected within the spirit and scope of the invention.

What is claimed is:

1. In an electrically activatable recording element comprising an electrically conductive support bearing
(a) a first layer, and, contiguous to the first layer,
(b) an electrically activatable recording layer,
the improvement wherein said first layer (a) is an inorganic electrically active conductive layer consisting essentially of a compound selected from the group consisting of silver chloride, silver bromide, silver iodide, transition metal bromides and chlorides, alkali metal chlorides, bromides and iodides, and combinations thereof capable upon electrically activated exposure and processing of said element of enhancing image formation in said electrically activatable recording layer.

2. An electrically activatable recording element as in claim 1 wherein said first layer (a) consists essentially of $RbAg_4I_5$.

3. An electrically activatable recording element as in claim 1 wherein said first layer (a) consists essentially of AgBr.

4. An electrically activatable recording element as in claim 1 wherein said first layer is about 25 Å to about 20,000 Å thick.

5. An electrically activatable recording element as in claim 1 wherein said layer (b) consists essentially of imaging composition containing a silver salt.

6. An electrically activatable recording element as in claim 1 wherein said layer (b) consists essentially of an imaging composition containing silver salt and a dye-forming compound.

7. In an electrically activatable recording element comprising an electrically conductive support bearing
(a) a first layer, and contiguous to the first layer,
(b) an electrically activatable recording layer comprising
(A) a dye-forming coupler, and
(B) an oxidation-reduction combination comprising
(i) an organic silver salt oxidizing agent, with
(ii) a reducing agent for the organic silver salt oxidizing agent, wherein the reducing agent, in its oxidized form, forms a dye with the dye-forming coupler,
the improvement wherein
said first layer (a) is an inorganic electrically active conductive layer consisting essentially of a compound selected from the group consisting of silver chlorides, silver bromides, silver iodides, transition metal bromides and chlorides, alkali metal chlorides, bromides and iodides, and combinations thereof capable upon electrically activated exposure and processing of said element of enhancing image formation in said electrically activatable recording layer.

8. An electrically activatable recording element as in claim 7 wherein said organic silver salt oxidizing agent consists essentially of a silver salt of a 1,2,4-mercaptotriazole.

9. An electrically activatable recording element as in claim 7 wherein said electrically conductive support comprises a poly(ethylene terephthalate) film having thereon a polymeric subbing layer and an electrically conductive cermet layer.

10. An electrically activatable recording element as in claim 7 wherein said electrically activatable recording layer comprises an electrically conductive polymeric binder.

11. An electrically activatable recording element as in claim 7 wherein said electrically activatable recording layer comprises an electrically conductive binder consisting essentially of a polyacrylamide.

12. In an electrically activatable recording element comprising a poly(ethylene terephthalate) film support having thereon an electrically conductive cermet layer and having on the cermet layer, in sequence:
(a) a first layer, and, contiguous to the first layer,
(b) an electrically activatable recording layer comprising in an electrically conductive polyacrylamide binder,
(A) a dye-forming coupler, and
(B) an oxidation-reduction combination consisting essentially of
(i) an organic silver salt oxidizing agent consisting essentially of a silver salt of 3-amino-5-benzylthio-1,2,4-triazole, with
(ii) a reducing agent consisting essentially of 4-amino-2-methoxy-N,N-5-trimethylaniline sulfate,
the improvement wherein
said first layer (a) consists essentially of AgBr.

13. An electrically activatable recording element as in claim 12 wherein said dye-forming coupler consists essentially of a compound selected from the group consisting of 2,6-dihydroxyacetanilide and 2,6-dihydroxytrifluoroacetanilide.

14. In an electrically activatable recording element comprising an electrically conductive support having thereon, in sequence:
(a) a first layer, and, contiguous to the first layer,
(b) an electrically activatable recording layer,
(c) a photoconductive layer separated from (b) by either (i) an air gap of up to 20 microns or (ii) an electrically conductive polymeric layer, and
(d) an electrically conductive layer,
the improvement wherein
said first layer (a) is an inorganic electrically active conductive layer consisting essentially of a compound selected from the group consisting of silver bromides, silver chlorides, silver iodides, transition metal bromides and chlorides, alkali metal chlorides, bromides and iodides, and combinations thereof capable upon electrically activated exposure and processing of said element of aiding image formation in said electrically activatable recording layer.

15. An electrically activatable recording element as in claim 14 wherein said first layer (a) consists essentially of $RbAg_4I_5$.

16. An electrically activatable recording element as in claim 14 wherein said first layer (a) consists essentially of AgBr.

17. An electrically activatable recording element as in claim 14 wherein said layer (b) consists essentially of a silver salt imaging composition.

18. An electrically activatable recording element as in claim 1 wherein said layer (b) consists essentially of a dye-forming silver imaging composition.

19. A dry, electrically activatable recording process for producing a dye image and silver image in an electrically activatable recording element comprising an electrically conductive support having thereon, in sequence,
(a) an inorganic electrically active conductive layer consisting of a compound selected from the group consisting of silver chlorides, silver bromides, silver iodides, transition metal bromides and chlorides, alkali metal chlorides, bromides and iodides, and combinations thereof, and, contiguous to the inorganic electrically active conductive layer,
(b) an electrically activatable recording layer comprising
(A) a dye-forming coupler, and
(B) an oxidation-reduction combination comprising
(i) an organic silver salt oxidizing agent, with
(ii) a reducing agent for the organic silver salt oxidizing agent, wherein the reducing agent, in its oxidized form, forms a dye with the dye-forming coupler, said process comprising the steps:

(I) applying an electrical potential imagewise to said recording element of a magnitude and for a time sufficient to produce in the image areas a charge density within the range of about $10^{-5}$ coulomb per $cm^2$ to about $10^{-8}$ coulomb per $cm^2$, said charge density forming a latent image in the electrically activatable recording layer; and, (II) heating said recording element substantially uniformly at a temperature and for a time sufficient to develop a dye image and silver image in said recording element.

20. A process as in claim 19 wherein said recording element in step (II) is heated to a temperature within the range of about 100° C. to about 200° C. until a dye image and a silver image are produced.

21. A dry, electrically activatable recording process for producing a dye image and a silver image in an electrically activatable recording element comprising a poly(ethylene terephthalate) film support having thereon an electrically conductive cermet layer and having on the cermet layer, in sequence:

(a) an electrically active conductive layer consisting of AgBr, and (b) an electrically activatable recording layer comprising, in an electrically conductive polyacrylamide binder, (A) a dye-forming coupler, and (B) an oxidation-reduction combination consisting essentially of (i) an organic silver salt oxidizing agent consisting essentially of a silver salt of 3-amino-5-benzylthio-1,2,4-triazole, with (ii) a reducing agent consisting essentially of 4-amino-2-methoxy-N,N,5-trimethylaniline sulfate, said process comprising the steps:

(I) applying an electrical potential imagewise to said recording element of a magnitude and for a time sufficient to produce in the image areas a charge density within the range of about $10^{-5}$ coulomb per $cm^2$ to about $10^{-8}$ coulomb per $cm^2$, said charge density forming a latent image in said recording layer; and, (II) heating said recording element substantially uniformly at a temperature and for a time sufficient to produce a dye image and silver image in said recording layer.

22. A dry electrically activatable recording process for producing a dye image and a silver image in an electrically activatable recording element comprising, in sequence:

(a) an electrically conductive layer, (b) a photoconductive layer, (c) an electrically activatable recording layer separated from (b) by either (i) an air gap of up to 20 microns or (ii) an electrically conductive polymeric layer, and comprising, in an electrically conductive binder, (A) a dye-forming coupler, and (B) an oxidation-reduction combination comprising (1) an organic silver salt oxidizing agent with (2) a reducing agent for the organic silver salt oxidizing agent, wherein the reducing agent in its oxidized form, forms a dye with the dye-forming coupler, (d) an electrically active conductive layer consisting of a compound selected from the group consisting of silver chlorides, silver bromides, silver iodides, transition metal bromides and chlorides, alkali metal chlorides, bromides and iodides, and combinations thereof, on (e) an electrically conductive support, said process comprising the steps:

(I) imagewise altering the conductivity of said photoconductive layer in accord with an image to be recorded, (II) applying an electrical potential across said photoconductive layer and said recording layer of a magnitude and for a time sufficient to produce a latent image in the recording layer corresponding to the image to be recorded; and, (III) heating said recording layer substantially uniformly at a temperature and for a time sufficient to produce a dye image and a silver image in said recording layer.

23. A process as in claim 22 wherein said recording element in step (III) is heated to a temperature within the range of about 100° C. to about 200° C. until a dye image and silver image are produced.

24. A dry, electrically activatable recording process for producing a dye image and a silver image in an electrically activatable recording element comprising the steps:

(I) imagewise altering the conductivity of a photoconductive layer in accord with an image to be recorded;

(II) positioning the imagewise altered photoconductive layer from step (I) either (i) within 20 micons adjacent an electrically activatable recording layer of said electrically activatable recording element or (ii) on an electrically conductive polymeric interlayer contiguous to said electrically activatable recording layer of said electrically activatable recording element, said electrically activatable recording element comprising an electrically conductive support having thereon, in sequence:

(a) an inorganic electrically active conductive layer consisting essentially of a compound selected from the group consisting of silver chlorides, silver bromides, silver iodides, transition metal bromides and chlorides, alkali metal chlorides, bromides and iodides, and combinations thereof, and (b) said electrically activatable recording layer comprising (A) a dye-forming coupler, and (B) an oxidation-reduction combination comprising (i) an organic silver salt oxidizing agent with (ii) a reducing agent for the organic silver salt oxidizing agent, wherein said reducing agent, in its oxidized form, forms a dye with said dye-forming coupler, (III) applying an electrical potential across said photoconductive layer and recording layer of a magnitude and for a time sufficient to produce in the image areas of said recording layer corresponding to the imagewise altered portions of said photoconductive layer a charge density within the range of about $10^{-5}$ coulomb per $cm^2$ to about $10^{-8}$ coulomb per $cm^2$, said charge density forming in said areas a latent image; and, (IV) substantially uniformly heating the recording element at a temperature and for a time sufficient to produce a dye image and a silver image in said recording element.

25. A dry, electrically activatable recording process for producing a dye image and a silver image in an electrically activatable recording element comprising on an electrically conductive support, in sequence, (a) an inorganic electrically active conductive layer consisting essentially of a compound selected from the group consisting of silver chlorides, silver bromides, silver iodides, transition metal bromides and chlorides, alkali metal chlorides, bromides and iodides, and combinations thereof, and (b) an electrically activatable recording layer comprising (A) a dye-forming coupler, and (B) an oxidation-reduction combination comprising (i) an organic silver salt oxidizing agent with (ii) a reducing agent for the organic silver salt oxidizing agent, wherein said reducing agent, in its oxidized form, forms a dye with the dye-forming coupler, said process comprising the steps:

(I) positioning said recording element in face-to-face relationship with a photoconductive element wherein said recording element is separated from said photoconductive element by either (i) an air gap of up to 20 microns or (ii) an intermediate electrically conductive polymeric interlayer;

(II) exposing said photoconductive element to an imagewise pattern of actinic radiation while simultaneously applying an electric potential having a field strength of at least about $1\times10^3$ volts/cm across said photoconductive element and said recording element for a time sufficient to provide a latent image in the areas of the recording element corresponding to the exposed areas of said photoconductive element; and (III) substantially uniformly heating the recording element at a temperature and for at time sufficient to produce a dye image and a silver image in said recording element.

* * * * *